US010458618B2

(12) United States Patent
Gloss et al.

(10) Patent No.: US 10,458,618 B2
(45) Date of Patent: Oct. 29, 2019

(54) LIGHTING APPLIANCE FOR ENGINE VEHICLES

(71) Applicant: Varroc Lighting Systems, s.r.o., Senov u Noveho Jicina (CZ)

(72) Inventors: Tomas Gloss, Vitkov (CZ); Tomas Mateju, Bartosovice na Morave (CZ); Milan Stylarek, Mikulcice (CZ)

(73) Assignee: Varroc Lighting Systems, S.R.O., Senov U Noveho (CZ)

( * ) Notice: Subject to any disclaimer, the term of this patent is extended or adjusted under 35 U.S.C. 154(b) by 0 days.

(21) Appl. No.: 15/299,229

(22) Filed: Oct. 20, 2016

(65) Prior Publication Data

US 2017/0122520 A1 May 4, 2017

(30) Foreign Application Priority Data

Oct. 30, 2015 (CZ) ..... 2015-769

(51) Int. Cl.
*F21S 43/31* (2018.01)
*F21S 43/14* (2018.01)
(Continued)

(52) U.S. Cl.
CPC ..... *F21S 43/31* (2018.01); *F21S 43/14* (2018.01); *F21S 43/195* (2018.01);
(Continued)

(58) Field of Classification Search
CPC ..... F21S 48/1154; F21S 48/1159; F21S 48/1163; F21S 48/1195; F21S 48/217;
(Continued)

(56) References Cited

U.S. PATENT DOCUMENTS 8,960,979 B2 2/2015 Sanchez et al.
9,074,744 B2 7/2015 Tsukamoto
(Continued)

FOREIGN PATENT DOCUMENTS

DE 102004004398 A1 12/2004
DE 102009009087 A1 * 8/2010 ..... B60Q 1/0058
(Continued)

OTHER PUBLICATIONS

Search Report from Corresponding Application CZ PV 2015-769 dated Nov. 23, 2015 (3 pages).
(Continued)

*Primary Examiner* — Mariceli Santiago
(74) *Attorney, Agent, or Firm* — Hovey Williams LLP

(57) ABSTRACT

A light appliance, particularly a signal lamp for engine vehicles, is provided that comprises a primary optical unit (4) with at least one light source (8), a secondary optical unit (5) comprising at least one areal electro-luminescent diode (12) for emitting light with its light emitting surface (121), and at least one reflective surface (61) of a reflective device (6) for reflecting light from the primary optical unit (4) falling onto the reflective surface (61). At least one of the electro-luminescent diodes (12) of the secondary optical unit (5) is arranged, with respect to some of the reflective surfaces (61), in such a way that at least a part of the light beams from the primary optical unit (4), directed to the reflective surface (61), passes before falling onto the reflective surface (61) and/or after reflection from reflective surface (61) through light emitting surface (121) of diode (12).

15 Claims, 9 Drawing Sheets

(51) Int. Cl.

| | |
|---|---|
| ***F21S 43/20*** | (2018.01) |
| ***F21S 45/47*** | (2018.01) |
| ***F21S 43/19*** | (2018.01) |
| *F21Y 115/10* | (2016.01) |

(52) U.S. Cl.
CPC ..... *F21S 43/255* (2018.01); *F21S 45/47* (2018.01); *F21Y 2115/10* (2016.08)

(58) Field of Classification Search
CPC .. F21S 41/155; F21S 41/18; F21S 43/14–145; F21S 43/30–33; B60Q 1/0041–0058
See application file for complete search history.

(56) References Cited

U.S. PATENT DOCUMENTS

| | | | | |
|---|---|---|---|---|
| 2003/0227774 | A1* | 12/2003 | Martin | F21V 7/09 362/240 |
| 2006/0077683 | A1 | 4/2006 | Muller et al. | |
| 2009/0046474 | A1 | 2/2009 | Sato et al. | |
| 2009/0296416 | A1* | 12/2009 | Luo | F21K 9/00 362/487 |
| 2013/0027960 | A1* | 1/2013 | Dubosc | B60Q 1/0052 362/520 |
| 2013/0106294 | A1 | 5/2013 | Rakuff et al. | |
| 2013/0235572 | A1 | 9/2013 | Aurongzeb et al. | |
| 2014/0022782 | A1* | 1/2014 | Tessnow | F21S 41/19 362/235 |
| 2014/0286034 | A1* | 9/2014 | Yamada | B60Q 1/2607 362/518 |
| 2015/0062946 | A1 | 3/2015 | Fukai et al. | |
| 2016/0040847 | A1* | 2/2016 | Ikuta | F21S 48/215 362/516 |
| 2016/0040853 | A1* | 2/2016 | Heine | F21S 48/1154 362/509 |
| 2016/0178152 | A1* | 6/2016 | Albou | F21S 48/1163 362/511 |

FOREIGN PATENT DOCUMENTS

| | | | | | |
|---|---|---|---|---|---|
| EP | 2390137 | A1 | | 11/2011 | |
| EP | 2453167 | A1 | * | 5/2012 | B60Q 1/0058 |
| EP | 2194312 | B1 | | 4/2014 | |
| FR | 2896029 | A1 | | 7/2007 | |
| JP | 2002083507 | A | * | 3/2002 | |
| JP | 2006196196 | A | * | 7/2006 | |
| JP | 2014192000 | A | | 10/2014 | |
| JP | WO 2014156668 | A1 | * | 10/2014 | F21S 48/215 |
| WO | 2008/023313 | A1 | | 2/2008 | |
| WO | 2011107904 | A1 | | 9/2011 | |
| WO | WO 2011107904 | A1 | * | 9/2011 | F21S 48/1163 |
| WO | WO 2017031517 | A1 | * | 3/2017 | F21S 48/1163 |

OTHER PUBLICATIONS

First Office Action from Corresponding German Application 10 2016 120 542.7 dated Oct. 18, 2017 (9 pages).

* cited by examiner

LIGHTING APPLIANCE FOR ENGINE VEHICLES

RELATED APPLICATIONS

This applications claims the priority benefit of Czech Patent Application No. PV 2015-769, filed on Oct. 30, 2015, the entire disclosure of which is incorporated herein by reference.

FIELD OF INVENTION

The invention relates to a light appliance, particularly a lamp for engine vehicles. Thus, the invention falls within the area of designing signal lamps, particularly for engine vehicles, and relates to a light appliance fitted with illuminating units to provide various lighting functions.

STATE OF THE ART

The lamp, particularly that for engine vehicles, includes several illuminating units, where each of these illuminating units provides different lighting functions or contributes to providing for required radiation characteristic of the light trace. Individual illuminating units are usually housed in a shaped load-bearing casing of the lamp, wherein each unit includes at least one light source and other optical elements. The light source emits light beams; optical elements are a system of refractive and reflective surfaces and boundaries of optical media influencing direction of light beams in creating the outlet light trace.

European Patent Application Publication No. EP2390137 and U.S. Patent Application Publication No. 2015/0062946 disclose embodiments of tail signal lamps for engine vehicles configured to provide various lighting functions, such as tail position lights and stop lights. The optical unit is fitted with an assembly of mirror surfaces. The light emitted from the lighting unit in the form of LED sources or organic diodes OLED is directed to a semipermeable mirror where a part of the light passes through the semipermeable mirror in the direction of the optical axis and a part of the light is reflected under a certain angle back to the internal space of the lamp, where the light falls onto the mirror surface, which reflects the light again back in the direction of the optical axis, i.e., towards the semipermeable mirror. In this way, the light reflection is repeated several times, wherein number of reflections is given by intensity of light emitted by light sources. A user standing in the direction of the optical axis perceives a view of a 3D-effect of receding patterns. This concept provides for two lighting functions at the same time; the tail outline light and stop light that differ just in intensity of light emitted in the direction of the optical axis. U.S. Pat. No. 8,960,979 discloses an illuminating appliance that includes a flat light source emitting light beams in the direction of a reflective surface for directing light beams in the direction of the optical axis. A disadvantage of the above solutions is that the illuminating appliances are not configured to provide several different light functions and that, at the same time, there are big demands for built-up space necessary for fitting the illuminating appliance into the vehicle body.

U.S. Pat. No. 9,074,744 discloses an illuminating appliance including a transparent flat illuminating fixture emitting light, where light is emitted from two opposite-oriented outlet surfaces to reflectors so that, from the front view, a space effect is created. The flat illuminating fixture can be fitted with several zones for ensuring outlet light trace for the stop light, tail outline light, and/or directing light. A disadvantage of this solution is that the illuminating appliance is not configured to provide several different light functions and that, at the same time, there are big demands for built-up space necessary for fitting the illuminating appliance into the vehicle body.

The objective of this invention is to design a light appliance, particularly a signal lamp for engine vehicles, that has low requirements for being built-up in the vehicle body, provides for creating space light effects or meeting other design requirements of the outlet light beam and, at the same time, is configured to provide for several lighting functions of the lamp.

SUMMARY OF INVENTION

The above mentioned objectives of the invention are met by a light appliance, particularly a signal lamp for engine vehicles, comprising a primary optical unit with at least one light source, a secondary optical unit comprising one or more areal electro-luminescent diodes for emitting light with its light emitting surface, and one or more reflective surfaces of a reflective device for light reflection from the primary optical unit falling onto the reflective surface. In various embodiments, the electro-luminescent diodes can comprise a first electro-luminescent diode. Furthermore, the first electro-luminescent diode of the secondary optical unit can be arranged towards some of the reflective surfaces in such a way that at least a part of the light beams from the primary optical unit, which are directed to the reflective surfaces, passes, before falling onto the reflective surfaces and/or after reflecting from the reflective surfaces, through the light-emitting surface of the diode.

According to one embodiment, at least one of the reflective surfaces of the reflective device is at least partially situated in the internal space of the electro-luminescent diode or on the rear surface of the electro-luminescent diode.

According to another embodiment, at least a part of at least one the reflective surfaces of the reflective device is separated from the rear surface of the first electro-luminescent diode by a free space.

According to yet another embodiment, the reflective surfaces are configured for light diffusion.

The reflective surfaces are preferentially configured to create required reflective outlet light traces and the electro-luminescent diodes are configured to create required emitted outlet light surface.

According to one of the preferred embodiments, the secondary optical unit includes at least two electro-luminescent diodes including at least one pair of electro-luminescent diodes positioned next to each other and emitting light beams of different colours.

At least one of the light sources is preferentially an LED diode.

According to another of the preferred embodiments, two light sources of the primary optical unit that are situated next to each other can emit light beams of different colours and/or at least one light source includes at least two chips (81) for creating light beams of different colours.

Preferentially, the light sources are housed on a single printed circuit board fixed to a carrier.

The carrier preferentially comprises a cooler for removing heat generated by the light sources.

According to one of the preferred embodiments, an optical element concentrating light beams into a precisely directing beam is situated at least at one light source.

The optical element preferentially includes a reflector, a light guide, a lens, and/or a collimating element.

The optical element preferentially comprises a compact fixture fitted with at least one outlet surface.

According to one of the preferred embodiments, the primary optical unit and/or the secondary optical unit are connected to a control unit to provide for required outlet characteristic of the reflective outlet light trace and emitted outlet light trace, where the light sources and/or the electro-luminescent diodes are controllable, alternately and/or jointly, by an electronic control unit to provide for day lightening, position light, fog light, reversing light, directing light, tail outline light, and/or head outline light.

Preferentially, the primary optical unit and secondary optical unit are installed in an internal chamber where a covering mask is also situated.

According to one of the preferred embodiments, an optical segment configured for diffusing light beams is situated in the internal chamber.

BRIEF DESCRIPTION OF THE FIGURES

Embodiments of the present invention are described herein with reference to the following drawing figures, wherein.

EXAMPLES OF EMBODIMENTS OF THE INVENTION

Figure 1:
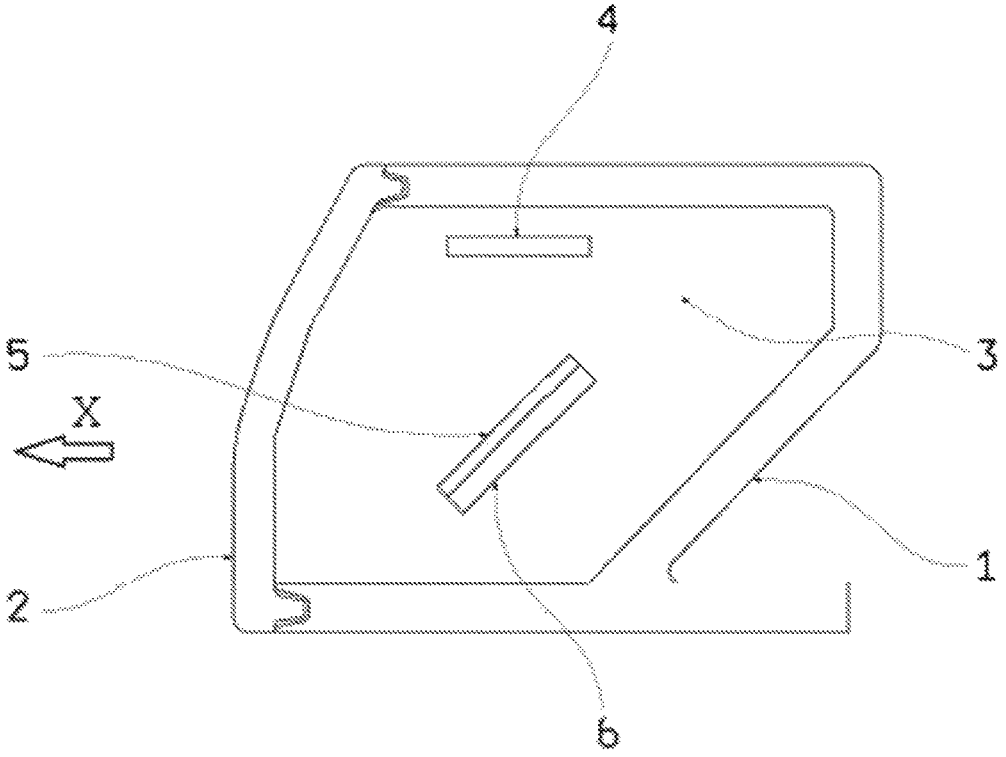
FIG. 1 depicts the optical assembly of the light appliance according to one embodiment of the present invention.
Figure 2:
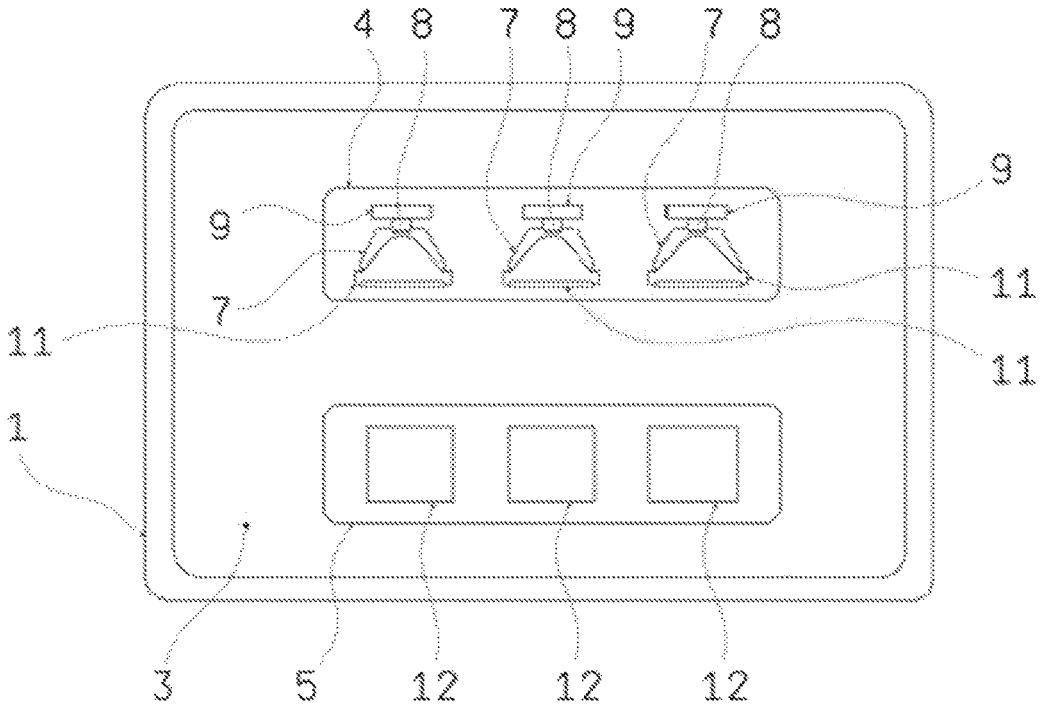
FIG. 2 depicts a frontal view of the optical assembly embodiment of FIG. 1.
Figure 3:
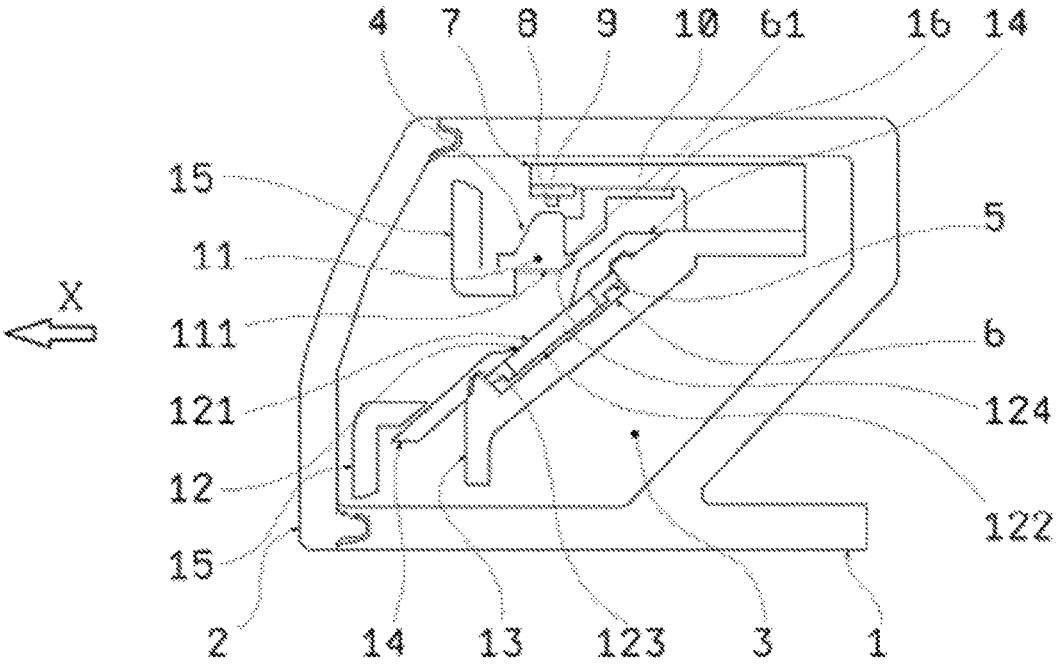
FIG. 3 depicts a detailed arrangement of the optical assembly of FIG. 2.

As depicted in FIGS. 1-3, the light appliance includes a load-bearing casing 1 covered by a transparent casing 2 and an internal chamber 3, which houses a primary optical unit 4, a secondary optical unit 5, and a reflective device 6. As shown in FIG. 2, the primary optical unit 4 can comprise three illuminating devices 7 with at least one light source 8, for example an LED, installed on a printed circuit board 9 fixed to a carrier 10. At each light source 8 there is an optical element 11 concentrating light beams to a precisely directing beam. The secondary optical unit 5 also includes three areal electro-luminescent diodes 12, which can comprise an OLED.

As shown in FIG. 3, the reflective device 6 is in the form of a planar board including reflective surfaces 61 which is installed on rear surfaces 122 of the electro-luminescent diode 12. The electro-luminescent diode 12 is housed on holder 13, wherein it is inclined so that it will overlay, completely or partially, the reflective surface 61 of the reflective device 6 with its light emitting surface 121 from the front view. From the front side, in the direction of optical axis X, casing 14 of a frame shape is situated before the electro-luminescent diode 12; from the front view, this casing preferentially overlays outer border 123 of electro-luminescent diodes 12. Optical element 11 is, by means of fixing element 16, mounted on carrier 10.

Figure 4:
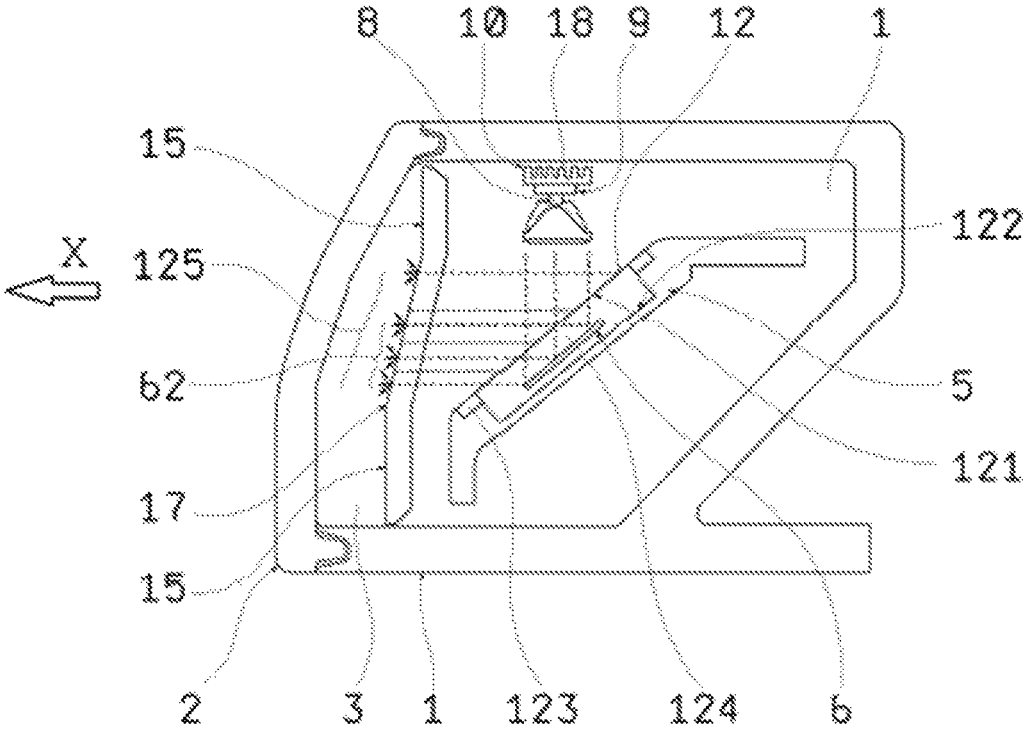
FIG. 4 depicts a side view (cross-section) of a second embodiment of the light appliance according to the present invention.
Figure 5:
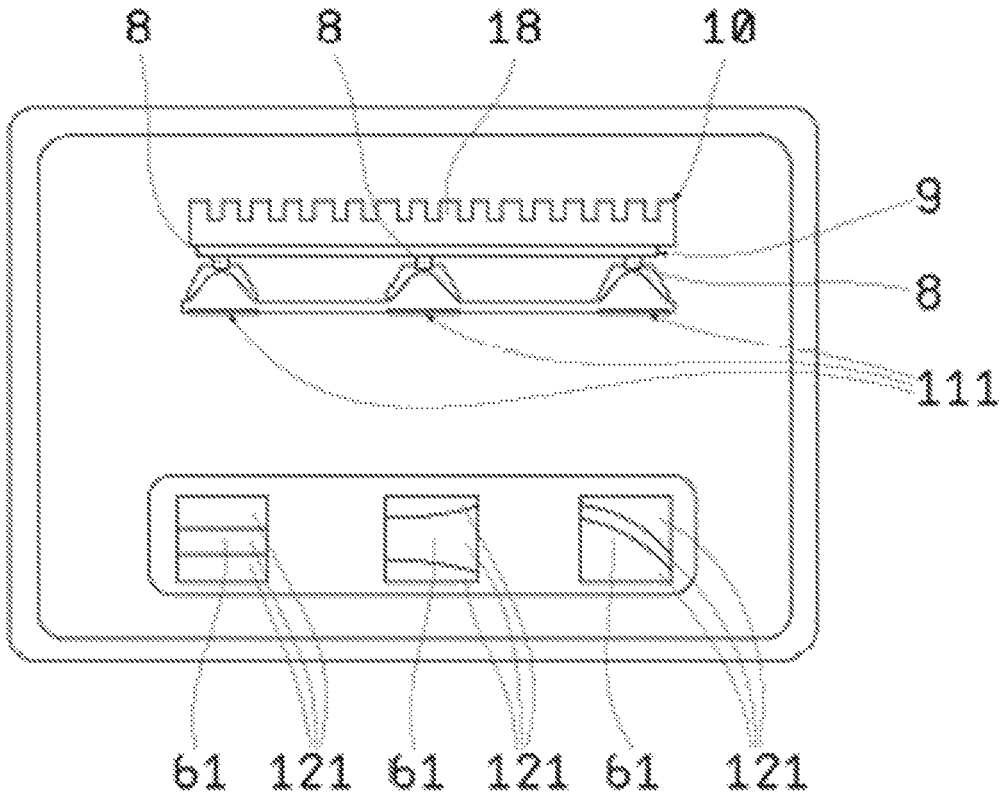
FIG. 5 depicts a frontal view of the embodiment of FIG. 4.

FIGS. 4 and 5 depict another embodiment of the light appliance, wherein optical segment 17, for example a filter, is configured for diffusing light beams situated in the internal chamber 3. The light appliance includes reflective device 6. In this case, reflective device 6 comprises a metal-plated electrode of electro-luminescent diode 12, situated in internal space 124 of the electro-luminescent diode 12 and it is specular, i.e., configured for mirror reflection of light beams. Non-demonstrated organic light-emitting layers of the electro-luminescent diode 12 are deposited on the reflective surface 61 in the form of a metal-plated layer/electrode.

For reaching additional design features, the reflective device 6 can be space-shaped in such a way that the shape of the reflective outlet light trace 62 going out from the reflective device 6 in the direction parallel with axis X does not correspond to that of emitted outlet light trace 125 going out from the electro-luminescent diode 12. Light sources 8 are installed on a single printed circuit board 9 that is fixed to carrier 10, which can comprise a cooler 18 for removal of heat generated by light sources 8. The optical element comprises a compact fixture fitted with three outlet surfaces 111.

Figure 6:
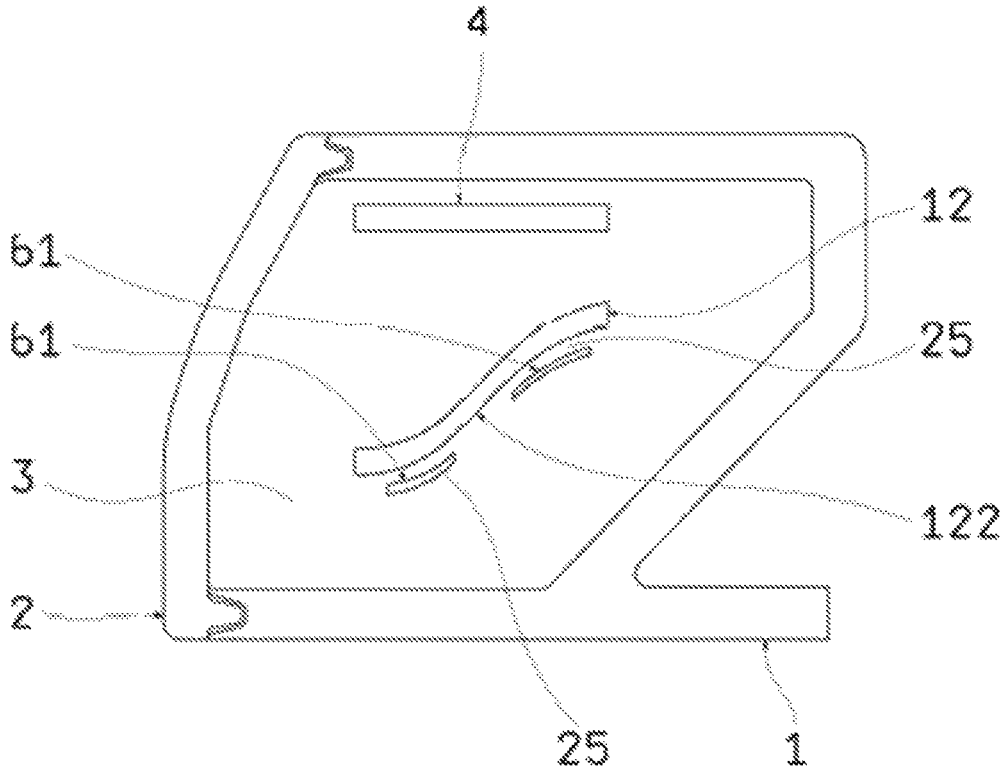
FIG. 6 depicts a third embodiment of the light appliance according to the present invention.

FIG. 6 demonstrates another embodiment, wherein the reflective surfaces 61 and/or electro-luminescent diode 12 can be space-shaped, for example, in the form of a corrugated board. Furthermore, the reflective device 6 includes two separated reflective surfaces 61 set-off from the rear surface 122 of the electro-luminescent diode 12 in such a way that there is free space 25 between the reflective device 6 and the electro-luminescent diode 12. In addition, the reflective surfaces 61 are configured for diffusing light, for example, by means of a white material.

Figure 7:
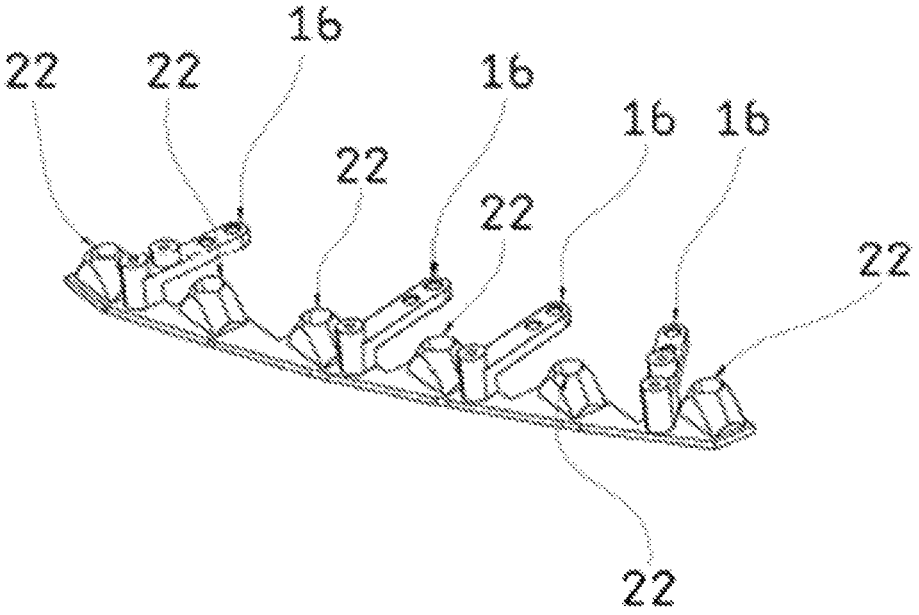
FIG. 7 depicts a preferred embodiment of the optical element in the form of a compact fixture.

FIG. 7 represents a preferred embodiment of optical element 11 in the form of a compact fixture comprising six collimating elements 22 for binding light from a light source (not demonstrated here) and four fixing elements 16 for connecting the optical element 11 with a carrier 10.

Figure 8:
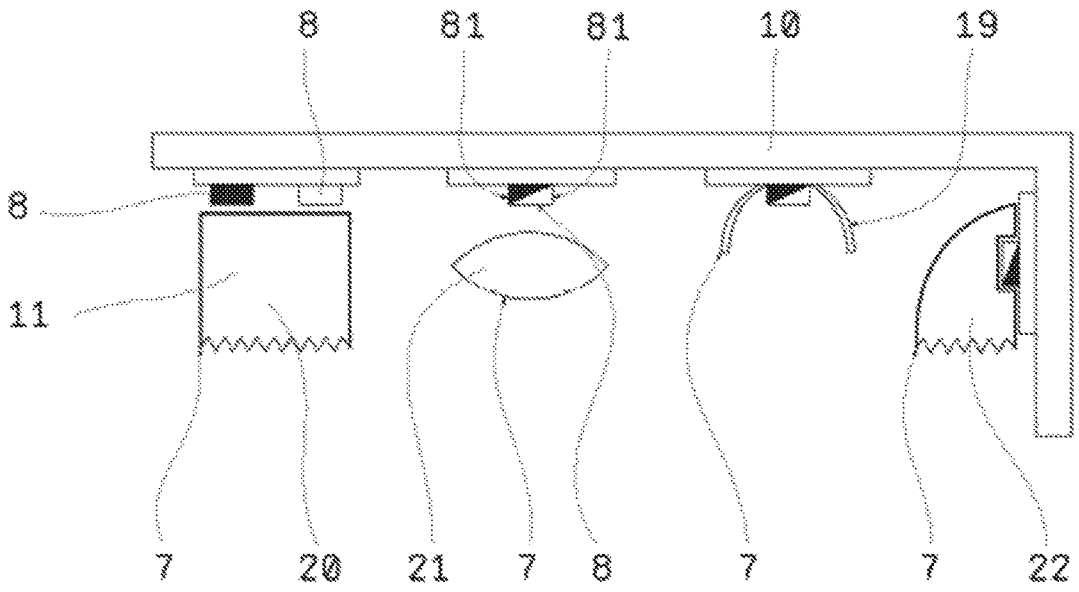
FIG. 8 depicts a preferred embodiment of the primary optical unit.

The preferred embodiment of the primary optical unit is demonstrated in FIG. 8, which includes four illuminating devices 7 fixed to a single carrier 10, wherein each of the illuminating devices 7 is configured for emitting light beams of two different colours. First illuminating device 7 includes optical element 11 and two light sources 8 situated next to each other, which emit light beams of different colours. The remaining three illuminating devices 7 contain two or more chips 81 for creating two and more light beams of different colour, wherein the optical element situated at each illuminating device 7 comprises a different form of reflector 19, light guide 20, lens 21, and/or collimating element 22.

Figure 9:
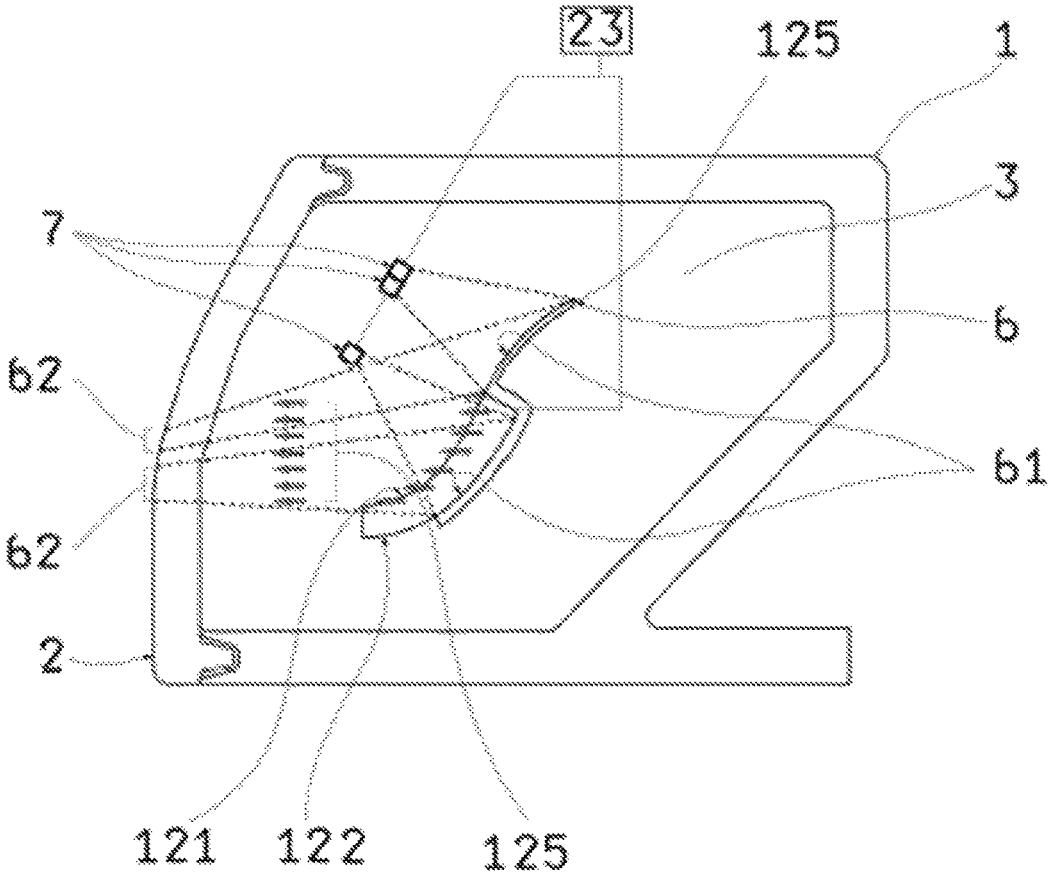
FIG. 9 depicts a third embodiment of the light appliance according to the present invention.

FIG. 9*a* demonstrates another embodiment of the present invention, wherein one reflective surface 61 of the reflective device 6 is, from the front view, situated behind the rear surface 122 of the electro-luminescent diode 12 (i.e., behind its surface that does not emit light). In addition, the second reflective surface 61 is, from the front view, not overlaid by electro-luminescent diode 12. Furthermore, the illuminating devices 7 are configured for directing light beams onto the reflective surfaces 61. The illuminating devices 7 and the electro-luminescent diode 12 are connected to control unit 23 to provide for required outlet characteristic of light traces 62, 125, wherein light sources of illuminating devices 7 and/or electro-luminescent diode 12 are controllable, alternately and/or jointly, by electronic control unit 23 to provide for day lightening, position light, fog light, reversing light, directing light, tail outline light, and/or head outline light.

Going back to FIG. 4, the light beams emitted by primary optical unit 4 by means of light source 8 are bound/emitted to optical elements 11, from which the light beams are directed to electro-luminescent diode 12. The light beams pass through the internal space 124 of the transparent, flat-shaped, electro-luminescent diode 12 and fall onto reflective surfaces 61 of the reflective unit 6, which reflects the light beams into the direction of optical axis X. At the same time, the light beams can be emitted by secondary optical unit 5 by means of the electro-luminescent diodes 12, which provide for obtaining required radiation characteristic of the lamp in a pre-specified space. Some or all of the required light functions are ensured by means of optical units 4, 5, which are capable of emitting light beams jointly but also individually. Furthermore, optical units 4, 5 can be configured for emitting light beams of different colours. In addition, the electro-luminescent diode 12 of the secondary optical unit 5 or the illuminating device 7 of primary optical unit 4 emits orange, red, white, light, blue light, and/or green light.

LIST OF RELATIONAL MARKS

1—load-bearing casing
2—translucent casing
3—internal chamber
4—primary optical unit
5—secondary optical unit
6—reflective device
7—illuminating device
8—light source
9—printed circuit board
10—carrier
11—optical element
12—electro-luminescent diode
13—holder
14—casing
15—covering mask
16—fixing element
17—optical segment
18—cooler
19—reflector
20—light guide
21—lens
22—collimating element
61—reflective surface
62—reflective outlet light trace
81—chip
111—outlet surface
121—light emitting surface
122—rear surface
123—outer border
124—internal space
125—emitted outlet light trace
23—control unit As used herein, the terms "including," "include," and "included" have the same open-ended meaning as "comprising," "comprises," and "comprise."

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second element" in the claims without departing from the scope of the present invention. Consistency is maintained within the description and each independent claim, but such nomenclature is not necessarily intended to be consistent therebetween.

The invention claimed is:

1. A light appliance for engine vehicles comprising:
a primary optical unit with at least one light source;
a secondary optical unit that comprises one or more electro-luminescent diodes for emitting light with a light emitting surface; and
at least one reflective surface of a reflective device for reflecting light from the primary optical unit falling onto the reflective surface,
wherein the at least one reflective surface comprises a first reflective surface,
wherein the electro-luminescent diodes comprise a first electro-luminescent diode having a rear surface,
wherein the first electro-luminescent diode of the secondary optical unit is arranged, with respect to the first reflective surface, in such a way that at least a part of the light beams from the primary optical unit directed to the first reflective surface passes, before falling onto the first reflective surface and after reflection from the first reflective surface, through a light-emitting surface of the first electro-luminescent diode,
wherein the first reflective surface is situated in an internal space or on the rear surface of the first electro-luminescent diode such that the first reflective surface does not entirely cover the rear surface of the first electro-luminescent diode.

2. The light appliance according to claim 1, wherein the first reflective surface is configured for diffusing light.

3. The light appliance according to claim 1, wherein the secondary optical unit includes at least two electro-luminescent diodes including at least one pair of electro-luminescent diodes positioned next to each other and emitting light beams of different colours.

4. The light appliance according to claim 1, wherein at least one of the light sources of the primary optical unit is an LED diode.

5. The light appliance according to claim 1, wherein two light sources of the primary optical unit are situated next to each other and emit light beams of different colour and/or at least one light source includes at least two chips for creating light beams of different colours.

6. The light appliance according to claim 1, further comprising an optical element situated at one or more light sources for concentrating light beams to a precisely directed beam.

7. The light appliance according to claim 6, wherein the optical element includes a reflector, a light guide, a lens, and/or a collimating element.

8. The light appliance according to claim 7, wherein the optical element comprises a compact fixture fitted with at least one outlet surface.

9. The light appliance according to claim 1, wherein the primary optical unit and/or the secondary optical unit are connected to a control unit for providing a required outlet characteristic of reflective outlet light trace and an emitted outlet light trace, wherein the light sources and/or the electro-luminescent diodes are controllable, alternately and/or jointly, by an electronic control unit to provide for day lightening, position light, fog light, reversing light, directing light, tail outline light, and/or head outline light.

10. The light appliance according to claim 1, wherein the primary optical unit and secondary optical unit are installed in an internal chamber, wherein the light appliance further comprises a covering mask.

11. The light appliance according to claim 10, further comprising an optical segment in the internal chamber configured for diffusing light beams.

12. The light appliance according to claim 1, wherein the primary optical unit is configured for emitting a light beam of a different colour relative to a light beam emitted by the electro-luminescent diodes of the secondary optical unit.

13. The light appliance according to claim 1, wherein the light source is housed on a printed circuit board fixed on a carrier comprising a cooler for removing heat generated by the light source.

14. The light appliance according to claim 1, wherein the at least one reflective surface is configured for creating a required reflective outlet light trace and the electro-luminescent diodes are configured for creating a required emitted outlet light trace.

15. The light appliance according to claim 1, wherein the light source is housed on a printed circuit board fixed on a carrier comprising a cooler for removing heat generated by the light source and wherein the at least one reflective surface is configured for creating a required reflective outlet light trace and the electro-luminescent diodes are configured for creating a required emitted outlet light trace.

* * * * *